United States Patent [19]

Miller et al.

[11] 4,373,450

[45] Feb. 15, 1983

[54] DISKETTE SAFE

[75] Inventors: Norman Miller; John F. McKinnis, Jr., both of Lafayette, Ind.

[73] Assignee: Schwab Safe Co., Inc., Lafayette, Ind.

[21] Appl. No.: 209,422

[22] Filed: Nov. 24, 1980

[51] Int. Cl.[3] ..... E06B 7/16

[52] U.S. Cl. ..... 109/75

[58] Field of Search ..... 109/76, 75, 82, 77

[56] References Cited

U.S. PATENT DOCUMENTS 342,003 5/1886 Gross ..... 109/75

3,709,169 1/1973 Gauger ..... 109/76

*Primary Examiner*—Robert Peshock

*Attorney, Agent, or Firm*—Cushman, Darby & Cushman

[57] ABSTRACT

A safe for storing and protecting the contents against high exterior temperatures in which the storage space is lined with foam insulation and a wax layer which melts to absorb heat energy. A drawer is slidably mounted for movement into and out of the space and sealed by an inner door with wide and narrow seals on the inner door periphery and door opening periphery embedding into each other. A pressure test hole extends between the storage space and the space outside the inner door for testing pressure. The inner door is locked by cams manually operated by a locking bar mounted on the outside of the inner door to engage locking posts within the cabinet. A hinged outer door provides an additional seal.

9 Claims, 1 Drawing Figure

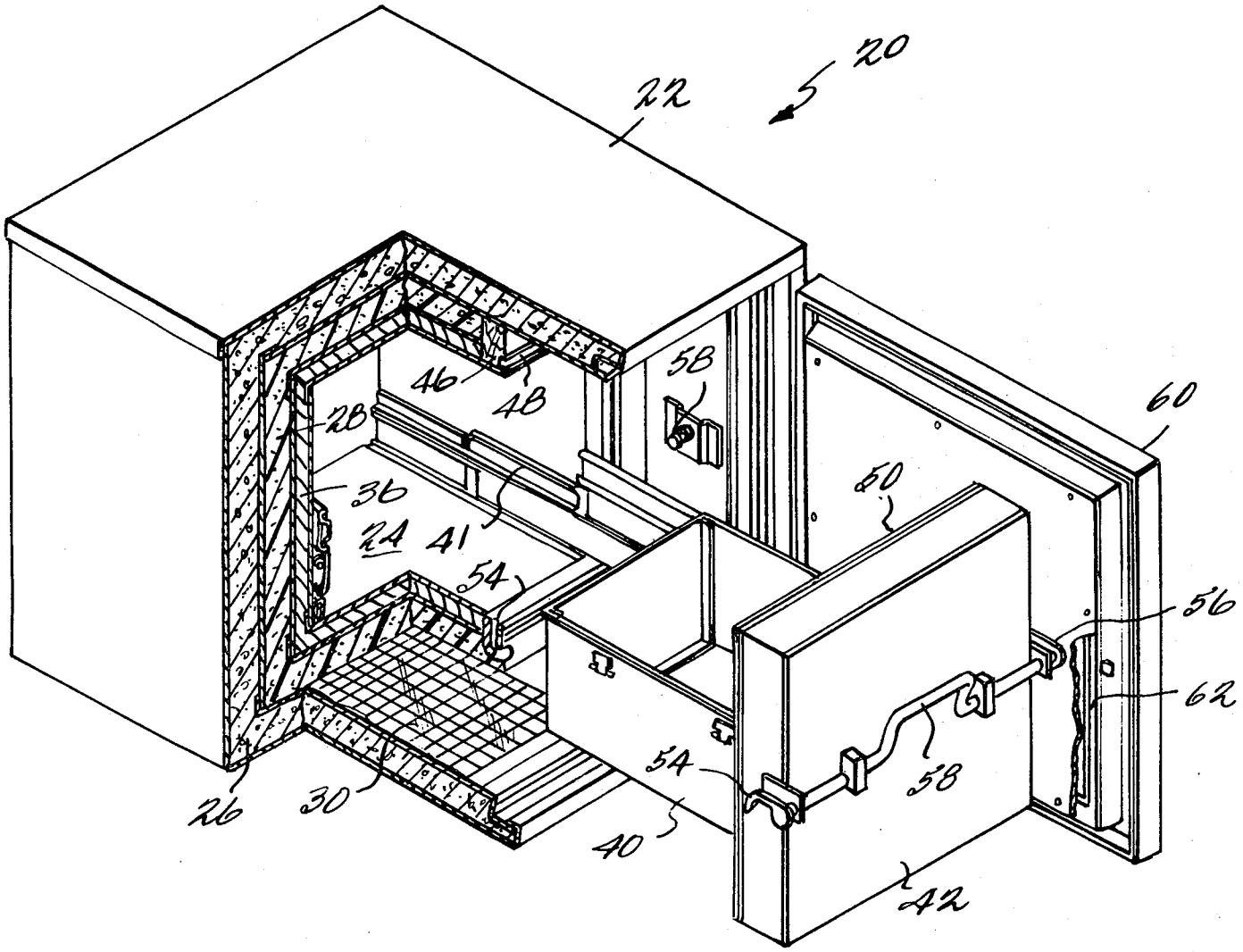
20
22
60
56
62
58
42
40
54
58
48
46
41
54
24
36
28
30
26

DISKETTE SAFE

BACKGROUND AND SUMMARY OF THE INVENTION

The invention relates to a safe for storing and protecting the contents against high exterior temperatures.

For many kinds of valuables, it is necessary to provide not only protection against theft or loss, but against damages from heat and/or humidity as well. Computer records are particularly vulnerable in that respect, since even a moderately rise in temperature above ambient temperature may result in destruction of the information on the records, and even destruction of the records themselves. In fact, it is desirable to maintain such records below 125 degrees F. and 80% humidity.

The present invention relates to a unique safe which can provide such protection against humidity and temperature and which incorporates a number of features which permit that capability.

The safe of the present invention includes layers of foam and wax within a cabinet and lining a storage space in which is mounted a drawer for movement in and out of the storage space through a door opening bounded by a frame. An inner door is mounted on the drawer for movement therewith to seal the door opening when the drawer is within the storage space. More particularly, a flexible seal, for example, of silicon foam is disposed on both the frame outside and above the periphery thereof and a similar second seal about the door seal. One of the seals is narrow, while the other is wide so that the narrow seal imbeds in the wider seal when the inner door is in its sealing position. A pair of locking bar cams on either side of the inner door engage locking posts within the cabinet and outside the storage space for locking the inner door. The bar cams are operated by a locking bar mounted on the outside of the inner door, and manually operable to lock and unlock the inner door.

A sealable pressure test hole is provided between the storage space and the space outside the inner door for testing the pressure within the storage space. In order to insure a positive seal with no heat or humidity leakage, air is forced inside the storage space after manufacture, and the pressure measured with a manometer. The locking cams are locked over the posts and the locking posts adjusted to maintain any desired column pressure, for example, a 2.5 inch water column pressure measured on the manometer. This pressure testing device is used primarily in the factory in adjusting the door seal, but it can also be used in the field for readjusting the seal at some later date. Of course, it would be necessary to reopen the pressure test hole, make the proper adjustments and reseal the pressure test hole.

A hinged outer door is also provided for sealing the door space. Hinged type door closures are better able to form a tight seal due to the hinge being able to compress and seal to a much greater degree than is possible with a filing cabinet type drawer front. Utilizing a double seal in this way permits the low temperature and humidity requirements as set forth above to be met.

Other objects and purposes of the invention will be clear from the following detailed description of the drawings.

BRIEF DESCRIPTION OF THE DRAWING

The drawing shows an exploded partial sectional view of the unique safe of the present invention.

DETAILED DESCRIPTION OF THE DRAWING

Reference is now made to the drawing which illustrates an exploded partially sectional view of the safe 20 of the present invention. Safe 20 includes a cabinet 22 defining therein a storage space 24 for valuables to be protected in a door opening. A layer of foam insulation formed with an outer insulation layer 26 and an inner insulation layer 28 separated by a vapor bag or layer 30. Within the layer of foam insulation, a layer of wax 36 which melts to absorb heat energy is provided. The layer of wax has a melting point below 125 degrees F., for example, 118 degrees F., and is of the type having high latent heat content to absorb much of the heat energy. A mixture of two different waxes sold by the National Wax Company under the designations Paxwax 6364-LA and 125/127 Special Technical Wax has been found to be satisfactory. The waxes can be blended to provide whatever melting point is desired.

A conventional drawer 40 is mounted on a slide mechanism 41 for movement in and out of the storage space 24. An inner door 42 is mounted at the outer end of drawer 40 for sealing the door opening when the drawer is within storage space 24. A wooden frame 46 extends about the periphery of the door opening and a silicone seal 48 extends around the periphery of the door opening on frame 46. A similar and wider silicon foam seal 50 is provided on the inner surface of door 42 so that silicon seal 40 embeds in seal 50 when the door is in its locking position. A test hole 54 extends between the inner storage space 24 and the space outside inner door 42 for pressure testing as described above. Pressure test hole 54 is normally sealed after testing at the factory as described above.

Inner door 42 is locked by means of two locking cams 54 and 56 which engage locking posts within cabinet 22. Only locking post 58 can be seen in the drawing since the other one has been removed in that view to show the partial sectional of the interior of the safe. Locking bar 58 connects the locking bar cams 54 and 56 and is manually rotated in order to lock and unlock the inner door.

A hinged outer door 60 provides the final seal of the door space and is a conventional type of hinged door safe.

A door cap seal 62 of flexible silicone rubber or the like is placed between the door cap and jambs to prevent hot gases from escaping and contacting the inner drawer head. The seal is held in place by the door cap and sheet metal screws as shown. A seal 3/32 inch thick and ½ inch wide is satisfactory.

Many changes and modifications in the above described embodiment of the invention can, of course, be carried out without departing from the scope thereof. Accordingly, that scope is intended to be limited only by the scope of the appended claims.

What is claimed is:

1. A safe for protecting the contents against high temperature and humidity comprising:

a cabinet having an interior storage space and a door opening;

a layer of insulation lining said storage space;

a layer of wax within said insulation layer for melting to absorb heat energy;

a drawer for holding said contents;

means for mounting said drawer for sliding movement in and out of said storage space through said door opening;

an inner door means mounted on said drawer for providing an inner seal in said door opening when said drawer is in said storage space;

means for locking said inner door means in sealing relation in said door space; and a hinged outer door for providing an outer seal of said door space.

2. A safe as claimed in claim 1, wherein said cabinet includes means defining a frame surface extending around said door opening and further including a first flexible door seal extending above and around said door opening on said frame surface and a second flexible door seal extending around the periphery of one of said inner door means, one door seal being wider than the other seal so that said other seal embeds in said one seal.

3. A safe as in claim 2, wherein said flexible door seals are silicon foam.

4. A safe as in claim 1 or 2, wherein said cabinet includes means defining a sealable opening between said storage space and the space outside said inner door means for testing the seal within said storage space.

5. A safe as in claim 1 or 2, wherein said wax layer is a mixture of waxes so as to maintain the temperature within said storage space below 125 degrees F. when exposed to exterior temperatures up to 1700 degrees F. for a period of one hour.

6. A safe as in claim 1 or 2, wherein said locking means includes first and second locking posts mounted inside said cabinet and outside said storage space, first and second cam members on said inner door means, for engaging said posts respectively and a locking bar mounted on the outside of said inner door means connecting said cam members and manually operable to lock and unlock said inner door means.

7. A safe as in claim 1 or 2, wherein said layer of insulation includes foam insulation.

8. A safe as in claim 1, wherein said insulation layer includes an inner and outer layer with a vapor bag therebetween.

9. A safe as in claim 1 or 2 further including a flexible door cap seal in said outer door.

* * * * *